US011697881B2

(12) United States Patent
Jahedi et al.

(10) Patent No.: US 11,697,881 B2
(45) Date of Patent: Jul. 11, 2023

(54) MANUFACTURE OF PIPES

(71) Applicant: Commonwealth Scientific and Industrial Research Organisation, Campbell (AU)

(72) Inventors: Mahnaz Jahedi, Toorak (AU); Stefan Gulizia, Werribee (AU); Bill Tiganis, Ripponlea (AU); Caixian Tang, Bulleen (AU); Saden Zahiri, Mount Waverly (AU)

(73) Assignee: Commonwealth Scientific and Industrial Research Organisation, Melbourne (AU)

( * ) Notice: Subject to any disclaimer, the term of this patent is extended or adjusted under 35 U.S.C. 154(b) by 602 days.

(21) Appl. No.: 16/708,874

(22) Filed: Dec. 10, 2019

(65) Prior Publication Data

US 2020/0332421 A1 Oct. 22, 2020

Related U.S. Application Data

(63) Continuation of application No. 12/921,332, filed as application No. PCT/AU2009/000276 on Mar. 6, 2009, now abandoned.

(30) Foreign Application Priority Data

Mar. 6, 2008 (AU) ..... 2008901088

(51) Int. Cl.
*C23C 24/04* (2006.01)
*B21C 37/06* (2006.01)

(52) U.S. Cl.
CPC ..... *C23C 24/04* (2013.01); *B21C 37/06* (2013.01); *B22F 2998/00* (2013.01)

(58) Field of Classification Search
CPC ..... B21C 37/00; B21C 37/06; B21C 37/065; B21C 45/00; B22F 5/106; C23C 24/00; C23C 24/02; C23C 24/04; C23C 24/045
See application file for complete search history.

(56) References Cited

U.S. PATENT DOCUMENTS

| | | | |
|---|---|---|---|
| 2,123,894 | A | 7/1938 | Hazelett |
| 3,596,344 | A | 8/1971 | Kreider |
| 4,256,779 | A | 3/1981 | Sokol et al. |
| 4,770,718 | A | 9/1988 | Verhoeven |
| 5,074,923 | A | 12/1991 | Siemers et al. |

(Continued)

FOREIGN PATENT DOCUMENTS

| | | |
|---|---|---|
| DE | 102007017753 | 10/2008 |
| EP | 0911426 | 4/1999 |

(Continued)

OTHER PUBLICATIONS

English translation of Japanese Office Action, App. No. 2014-240449, dated Jul. 19, 2016.

(Continued)

*Primary Examiner* — Vanessa T. Luk
(74) *Attorney, Agent, or Firm* — Womble Bond Dickinson (US) LLP

(57) ABSTRACT

The present invention relates to a method of manufacturing a pipe, which method comprises cold-gas dynamic spraying of particles onto a suitable support member thereby producing a pipe, and separating the pipe from the support member.

20 Claims, 1 Drawing Sheet

(56) References Cited

U.S. PATENT DOCUMENTS

| | | | | |
|---|---|---|---|---|
| 5,302,414 | A | 4/1994 | Alkhimov et al. | |
| 6,242,112 | B1 | 6/2001 | Forsberg et al. | |
| 7,128,948 | B2 | 10/2006 | Slattery | |
| 7,143,967 | B2 | 12/2006 | Heinrich et al. | |
| 7,201,940 | B1 | 4/2007 | Kramer | |
| 2002/0033161 | A1* | 3/2002 | Hoffmann ..... | F02F 1/004<br>29/888.06 |
| 2002/0073982 | A1 | 6/2002 | Shaikh et al. | |
| 2005/0001075 | A1 | 1/2005 | Heinrich et al. | |
| 2005/0084701 | A1 | 4/2005 | Slattery | |
| 2006/0108031 | A1 | 5/2006 | Haynes | |
| 2007/0036905 | A1 | 2/2007 | Kramer | |
| 2008/0220234 | A1 | 9/2008 | Ko et al. | |
| 2009/0282832 | A1 | 11/2009 | Haynes | |
| 2011/0223053 | A1 | 9/2011 | Jahedi et al. | |

FOREIGN PATENT DOCUMENTS

| | | |
|---|---|---|
| GB | 1599392 | 9/1981 |
| GB | 2245514 | 1/1992 |
| WO | 2000020146 | 4/2000 |
| WO | 2007070939 | 6/2007 |
| WO | 2009109016 | 9/2009 |

OTHER PUBLICATIONS

International Search Report and Written Opinion for WO 2009/109016, dated Apr. 7, 2009.

International Preliminary Report on Patentability for WO 2009/109016, dated Sep. 7, 2010.

* cited by examiner

MANUFACTURE OF PIPES

PRIORITY INFORMATION

This application is a continuation of co-pending application U.S. application Ser. No. 12/921,332, which claims priority from PCT patent application PCT/AU2009/000276 filed Mar. 6, 2009, which claims priority to Australian patent application no. 2008901088 filed Mar. 6, 2008, all of which are hereby incorporated by reference.

BACKGROUND OF THE INVENTION

The present invention relates to a method for the manufacture of pipes formed from, for example, metals, ceramics, polymers, composites and mixtures thereof. More specifically, the present invention relates to the manufacture of seamless pipes by application of cold-gas dynamic spraying (or cold spraying). The present invention also relates to pipes that have been manufactured in accordance with the method of the present invention. Titanium and titanium alloy pipes are of particular interest.

Pipes are typically produced by processes such as extrusion or spiral welding. In the extrusion process, a metal billet is heated and pierced with a suitable mandrel; this is followed by elongation, rolling, straightening, sizing and finishing, as necessary. In the spiral welded process, a sheet of material (e.g., titanium) is formed onto a roll and the sheet is seam welded in order to produce a pipe. Subsequent actions for spiral welded pipes include post heat-treatment, weld inspection, sizing and finishing, as necessary. These production processes tend to be labor intensive, involving high tooling costs and low productivity.

Against this background, it would be desirable to provide a process for manufacturing a pipe that does not suffer the disadvantages associated with these conventional techniques. Specifically, it would desirable to provide a method for manufacturing a pipe that is simple and has relatively high throughput.

SUMMARY OF THE DISCLOSURE

Accordingly, an aspect of the present invention provides a method of manufacturing a pipe, which method comprises cold spraying of particles onto a suitable support member (or substrate), thereby producing a pipe, and separating the pipe from the support member. Subject of course to the properties required of the pipe, the particles may comprise any material that is susceptible to cold spraying in order to develop a pipe structure on the support member. The particles may comprise one or more metals, ceramics, polymers, composites and combinations of any two or more of these materials. Compatibility issues may need to be considered when selecting combinations of materials to be used.

Cold spraying is a known process that has been used for applying coatings to surfaces. In general terms, the process involves feeding (metallic and/or non-metallic) particles into a high pressure gas flow stream which is then passed through a converging/diverging nozzle that causes the gas stream to be accelerated to supersonic velocities, or feeding particles into a supersonic gas stream after the nozzle throat. The particles are then directed to a surface to be deposited. The process is carried out at relatively low temperatures, below the melting point of the substrate and the particles to be deposited, with a coating being formed as a result of particle impingement on the substrate surface. The fact that the process takes place at relatively low temperature allows thermodynamic, thermal and/or chemical effects, on the surface being coated and the particles making up the coating, to be reduced or avoided. This means that the original structure and properties of the particles can be preserved without phase transformations etc. that might otherwise be associated with high temperature coating processes such as plasma, HVOF, arc, gas-flame spraying or other thermal spraying processes. The underlying principles, apparatus and methodology of cold spraying are described, for example, in U.S. Pat. No. 5,302,414.

Cold spraying is used to build up a pipe structure on the surface of a support member after which the support member is removed to produce a free-standing pipe structure. Separation of the pipe from the support member may be achieved by heating or cooling the pipe and/or the support member. Alternatively, separation of the pipe from the support member may be achieved by dissolving, melting, evaporating or breaking the support member.

Particles may be cold sprayed onto the surface of a suitable support member. Here it is to be appreciated that the surface of the support member is a surface upon which particles are deposited in order to build up a layer in the form of a pipe.

The support member may take a variety of configurations. Thus, in one embodiment the support member takes the form of a mandrel. In this case, the external surface of the mandrel will define the internal surface of the pipe to be produced. In the case that the mandrel is circular in cross-section, the external diameter of the mandrel will correspond to the internal diameter of the pipe to be produced.

In another embodiment, the support member may take the form of a shaped support member (or mold). In this case, the method involves cold spraying of particles onto the surface of the mold and here it will be appreciated that the inner surface of the mold will define the outer surface of the product to be produced. Thus, in the case that the support member includes a cavity extending through it and the cavity is circular in cross-section, the internal diameter of the cavity will correspond to the external diameter of the pipe to be produced. Typically the pipe to be produced will be circular in cross-section, although other possibilities are of course possible by use of a suitably shaped mold.

The surface of the support member to be coated with particles will influence the characteristics of the corresponding surface of the pipe to be produced. Desirably the surface of the support member to be coated is smooth and defect-free. The surface characteristics of the support member may influence the ease with which the support member and pipe may be separated by heating, cooling, dissolving, melting or evaporating as is required after formation of the pipe by cold spraying. An aluminum mandrel may, for example, be dissolved using sodium hydroxide.

When the surface of the support member to be coated is smooth and free of defects (e.g., scratches, dents, pits, voids, pinholes, inclusions, markings etc.) the surface of the pipe produced should also be smooth and defect-free. Such pipes may find application in the transport of suspensions wherein it is desirable to minimize the deposition of particles from a process fluid being transported through the pipe onto the inner pipe surface as this could lead to flow disruption and possibly blockage of the pipe.

In certain applications (e.g., heat exchangers), it may be desirable to employ pipes with a high surface area to maximize heat transfer across the pipe thickness. The magnitude and/or direction of the heat transfer may dictate which surface(s) of the pipes (internal and/or external) is/are designed to have a suitably high surface area. An aspect of the present invention permits the manufacture of a pipe with a high internal or external surface area by cold spraying a mandrel with a high external surface area or a mold with a high internal surface area, respectively. The surface of the mandrel or mold will be reproduced on a respective surface of the pipe and may include any structural feature(s) that will yield the desired surface area configurations in the pipe being produced. For example, the surface of the mandrel or mold may comprise one or more fins to impart a high surface area to a corresponding surface of the pipe. It is unlikely that such pipes could be manufactured using conventional production processes. In particular, high surface area pipes of the present invention comprising titanium and/or titanium alloy may be appropriate for use in heat exchangers.

One potential advantage of the present invention is that the composition that is applied by cold spraying may be varied along the length and/or across the thickness of the pipe to be produced. This may provide flexibility in terms of product characteristics. For example, to produce a metallic pipe that has different weld characteristics at opposing ends and this may be achieved by varying the composition as between the different ends. It may also be desirable to vary the composition across the thickness of the pipe. For example, it may be desirable to provide a pipe with a nickel dense inner region with less nickel dense (possibly cheaper) matter in outer regions.

Several different approaches are possible for varying the pipe composition. If a variation in the pipe properties (e.g., coefficient of thermal expansion) is desired along the length and/or across the thickness of the pipe, then the pipe composition may be varied accordingly. Thus, the pipe may comprise discrete lengths and/or layers of different materials or the composition of the pipe may be varied gradually along the length and/or across the thickness of the pipe or the pipe may comprise a combination of these arrangements.

If a pipe is to be manufactured from multiple materials, then the compatibility of the different materials must be considered. Should two or more of the proposed materials be incompatible in some way (e.g., coherence/bonding), it may be necessary to separate the incompatible materials by one or more regions of mutually compatible material(s). Alternatively, the pipe could be manufactured such that there is a gradual change in composition from one material to the next to ease any incompatibility problems between the materials used.

The present invention provides a technique of manufacturing a pipe comprising two or more distinct layers, wherein individual layers differ chemically (the composition of the particles may be varied) and/or physically (the size, packing density etc. of the particles used may be varied). The choice of materials for the innermost and outermost layers will generally be governed by the intended use of the pipe and the process fluids to which the internal and external pipe surfaces will be exposed during use. Thus, it may be desirable to produce a pipe wherein the internal and/or external surface is corrosion resistant or wear resistant. Where the properties of a layer of the pipe are not critical, it may be possible to form this layer using a relatively inexpensive material, thereby enhancing cost-effectiveness. Titanium and nickel (and their corresponding alloys) may be used to confer corrosion resistance against acidic and alkaline process fluids, respectively. Tungsten and/or tungsten carbide may be used to confer wear resistance against abrasive process fluids. Less expensive materials may include aluminum, copper and/or zinc.

The layer-by-layer approach may be particularly useful for the manufacture of multi-layered pipes with relatively small diameters. For example, consider a small pipe comprising an inner layer of titanium and an outer layer of a different material. It may prove extremely difficult (even impossible) to produce such a pipe by cold spraying the internal surface of a pre-fabricated pipe with titanium if the cold spraying nozzle is too large to move through the pipe cavity. However, according to an aspect of the present invention, such a pipe may be produced by cold spraying a uniform layer of titanium onto a mandrel (the external diameter of which corresponds to the internal diameter required for the pipe), followed by cold spraying a uniform layer of a different material onto the titanium coated mandrel, and then removing the mandrel to yield the multi-layered pipe. Precise control of the various process parameters permits suitable adhesion between the different layers comprising the pipe wall.

The pipe material preferably comprises titanium or titanium alloy. Titanium pipes are strong and corrosion resistant and an excellent candidate for transportation of water, oil, gas and various chemicals above and below ground and sub-sea. Titanium pipe manufacture using the cold spraying methodology of the present invention has also been found to meet stringent performance requirements and satisfies the need for a low cost alternative to conventional high temperature processes for pipe production.

After formation of a pipe on the support member, it is necessary to separate the support member and pipe. In one embodiment, separation takes place due to the difference in thermal expansion coefficient between the material of the support member and the material forming the pipe (cold spraying may lead to localized heating of the support member). Thus, when the support member takes the form of a mandrel, separation may be achieved by contraction of the mandrel away from the pipe that is formed on the outer surface of the mandrel. In this case, the coefficient of thermal expansion of the mandrel is chosen to be greater than the coefficient of thermal expansion of the pipe to be produced. It may also be beneficial to heat the support member prior to commencement of cold spraying.

In another embodiment, when the support member takes the form of a mold, separation of the mold from the pipe may be achieved when the material of the pipe has a higher coefficient of thermal expansion than the material of the mold. The mold can be made from wax or low melting point metals which can be dissolved, melted or evaporated. In this case, on cooling, the outer surface of the pipe contracts away from the inner surface of the mold.

The material for the support member may be selected based upon the material of the pipe to be produced. In one embodiment, when the support member takes the form of a mandrel and the pipe material comprises titanium particles, the mandrel may be formed of stainless steel.

In another embodiment, separation of the support member and pipe may be achieved by breakage of the support member. In this case, the support member may be formed of a ceramic material that is suitably rigid and temperature resistant to allow formation of the pipe on a surface of the support member, but suitably fragile to allow the support member to be broken and removed when separation of the support member and the pipe are required.

In an embodiment, the average size of the particles that are cold sprayed is likely to influence the density of the resultant deposition on the support member, and thus the density of the pipe that is formed. Preferably the deposition is dense and free from defects, connected micro-voids (leakage) and the like, since the presence of such can be detrimental to the quality of the resultant pipe. Typically the size of the particles applied by cold spraying is from 5 to 45 microns with an average particle size of 25 microns. One skilled in the art will be able to determine the optimum particle size or particle size distribution to use based on the morphology of the powder and characteristics of the pipe that is to be formed. Particles suitable for use in the present invention are commercially available.

The operating parameters for the cold spraying process may be manipulated in order to achieve a pipe that has desirable characteristics (density, surface finish etc). Thus, parameters such as temperature, pressure, stand off (the distance between the cold spraying nozzle and the support member surface to be coated), powder feed rate and relative movement of the support member and the cold spraying nozzle, may be adjusted as necessary. Generally, the smaller the particle size and distribution, the denser the layer formed on the surface of the support member. It may be appropriate to adapt the cold spraying equipment used in order to allow for higher pressures and higher temperatures to be used in order to achieve higher particle velocity and more dense microstructures, or to allow for pre-heating the particles.

An apparatus used for implementation of a method of the present invention is likely to be of conventional form and such equipment is commercially available or individually built. In general terms, the basis of the equipment used for cold spraying will be as described and illustrated in U.S. Pat. No. 5,302,414. Such cold spraying apparatus may be combined with equipment for holding and manipulating the support member, as required. For example, when the support member takes the form of a mandrel, a lathe may be used to rotate the mandrel with a deposition moved axially along the mandrel. In this case, rotation of the mandrel combined with axial movement of the nozzle is responsible for build up of a deposition on the support member in order to produce a pipe. Multiple nozzles may be used in tandem for cold spraying mandrels of considerable length, wall thickness and/or diameter. The use of multiple nozzles may also speed up the manufacturing process.

After manufacture of a pipe in accordance with the present invention, the pipe may be sized and finished. For example, the pipe may be rolled using a suitable roller that applies a fixed load to the outer surface of the pipe. Rolling may also provide sizing of the pipe prior to finishing. The pipe surface may be ground, machined or polished according to the end user specifications.

It is also possible to carry out rolling of the pipe during cold spraying or to omit the rolling (finishing) step altogether.

Advantages associated with the method of the present invention compared with conventional pipe manufacturing processes, are as follows:

1. Pipes of various grades and compositions can be manufactured directly from powder without melting.
2. The diameter of the pipe produced is limited only by the size of the support member used.
3. The method does not generally impose limitations on the wall thickness of the pipe produced.
4. There is no need for expensive dies or the forging, roll forming, welding or extrusion equipment currently used to manufacture pipes.
5. The method is adaptable to a variety of pipe materials (e.g., metals, ceramics, polymers, composites and mixtures thereof) and to the production of graded microstructures to suit various applications.
6. No atmospheric control is necessary during cold spraying.

These and other objects, features and advantages of the present invention will become more apparent in light of the following detailed description of preferred embodiments thereof, as illustrated in the accompanying drawings.

DETAILED DESCRIPTION

EXAMPLES

The following non-limiting examples illustrate particular embodiments of the present invention.

Example 1

Figure 1:
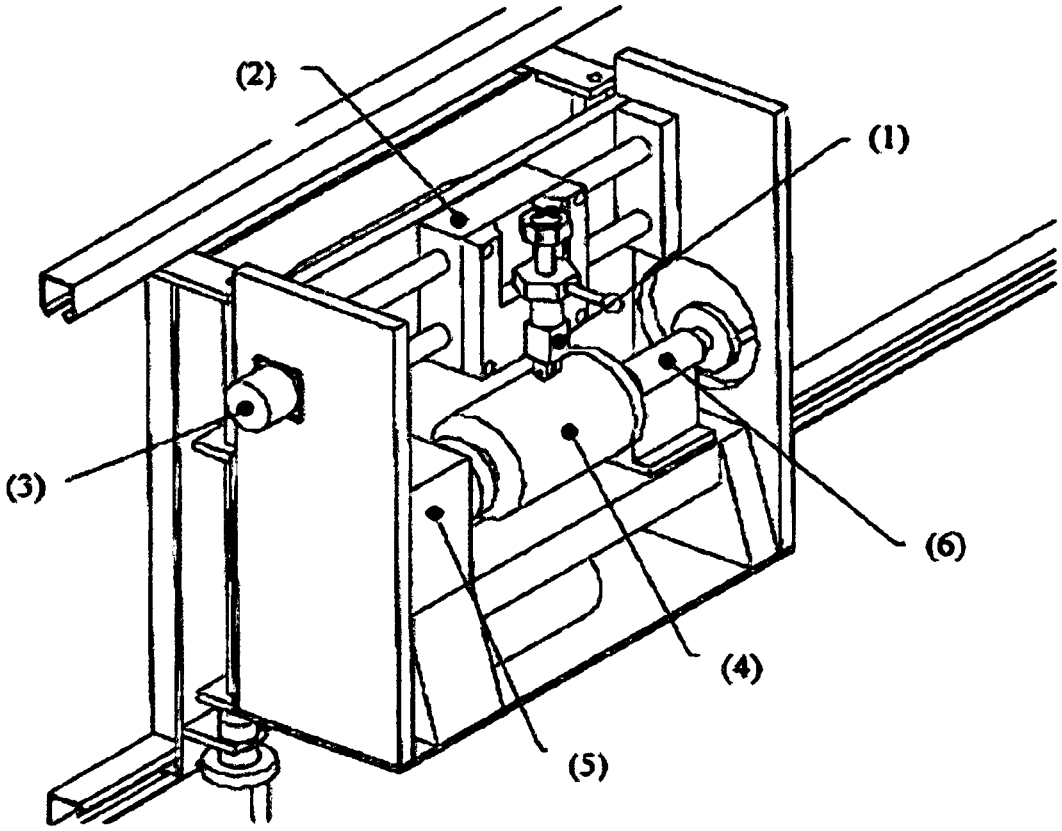
FIG. 1 is a pictorial illustration of a rolling test rig and lathe.

The method of the present invention may be conducted on the specially designed in situ rolling test rig and lathe illustrated in the accompanying drawing (FIG. 1). In particular, titanium pipes up to 125 mm in diameter (internal) and up to 450 mm in length may be manufactured on the test rig (with no limitations on the diameter, wall thickness and/or length of the pipes produced).

The (laboratory) facility of FIG. 1 is designed so that the rolling pressure, applied by the pressure roller head 1, may be maintained during cold spraying and the traverse speeds of both the pressure roller slide 2, driven by the slide drive motor 3, and the cold spraying nozzle (not shown) may be synchronized to move along the pipe as it is being formed. The cold spraying nozzle would typically be positioned directly opposite the mandrel. Multiple nozzles may be used in tandem for cold spraying mandrels of considerable length, wall thickness and/or diameter. The use of multiple nozzles may also speed up the manufacturing process. The mandrel 4 would be firmly fixed between the lathe drive head 5 and the lathe tailstock 6 so that it may be rotated at high speed for cold spraying deposition. Once the desired pipe length and wall thickness are achieved, the titanium coated mandrel may be detached from the test rig and the mandrel may be removed to reveal the cold sprayed titanium pipe.

Alternatively, titanium and/or titanium alloy pipes may be manufactured on the test rig by cold spraying titanium and/or titanium alloy powder onto the mandrel and omitting the rolling (finishing) step.

Typically, the cold spraying machine parameters are as follows:

Equipment: CGT Kinetic 3000 or 4000
Number of supersonic nozzles: one or more
Mandrel material: Stainless steel
Mandrel speed: up to 600 RPM
Stand-off: 20-100 mm
Spray material: CP Titanium and/or titanium alloy powder
Particle diameter: 10-30 microns
Gas pressure: 10-40 bar
Gas: Helium, nitrogen, argon or air
Carrier gas: Helium, nitrogen, argon or air or mixtures thereof
Powder feed rate: 10-200 g/min
Traverse rate: 10-100 mm/min

Example 2

Titanium/mild steel duplex pipes have been manufactured for transporting corrosive liquids. A stainless steel mandrel (external diameter, 50 mm; length, 300 mm) was cold sprayed with a 5 mm thick layer of commercially pure titanium. An additional 5 mm thick mild steel layer was deposited on the titanium layer to produce a duplex pipe of 10 mm thickness. The stainless steel mandrel was removed by utilizing the difference between the thermal expansion coefficient of titanium and the stainless steel.

Typically, the cold spraying machine parameters for producing the duplex pipe are as follows:

Equipment: CGT Kinetic 4000
MOC super sonic nozzle
Mandrel material: Stainless steel
Mandrel speed: up to 600 RPM
Stand-off: 30 mm
Spray material: Commercially pure Titanium and Mild Steel
Particle diameter: 10-30 microns for Titanium and Mild Steel
Gas pressure for titanium 38 bar and 35 bar for Mild Steel
Gas: Nitrogen 99.999% pure for both powders
Carrier gas: Nitrogen 99.999% pure for both powders
Powder feed rate: 30 g/min for both powders
Traverse rate: 20 mm/min for both powders Example 3

Figure 2:
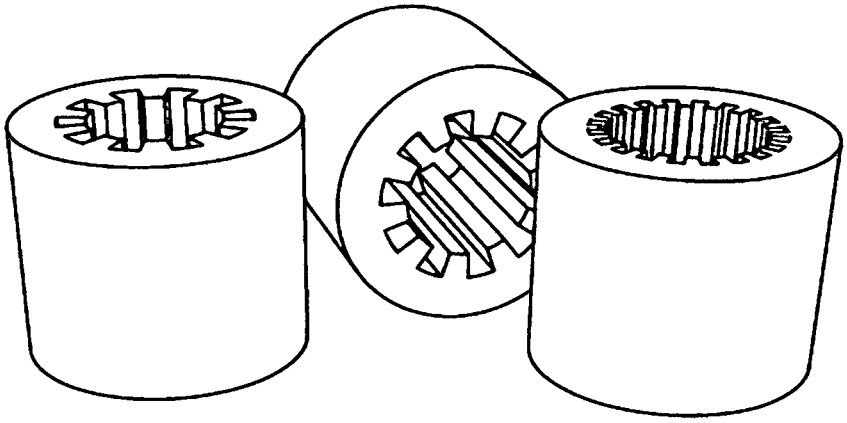
FIG. 2 is a pictorial illustration of titanium heat exchanger pipes.

Seamless titanium and titanium alloy pipes with complex internal shapes have been manufactured using cold spraying. An aluminum alloy mandrel was machined on the external surface to produce a spline shaped mandrel that in turn increased the internal surface area of the cold sprayed titanium pipe. The spline contained ten gear shaped teeth around the circumference and each tooth measured 3 mm wide by 3 mm deep. Alternatively the spline shape is not limited to the example provided and the spline tooth depth and width can be varied according to the amount of heat transfer required. The aluminum spline was placed in a lathe machine for the purpose of rotating the mandrel at the required speed. Titanium or titanium alloy was cold sprayed on the surface of the mandrel to build-up the wall thickness of the heat exchanger pipe to 6 mm thick. After cold spraying, the mandrel was removed by dissolving in a sodium hydroxide solution to reveal the titanium heat exchanger pipe. The titanium heat exchanger pipes are shown in FIG. 2.

Typically, the cold spraying machine parameters are as follows:

Equipment: CGT Kinetic 4000
MOC super sonic nozzle
Mandrel material: Aluminum alloy
Mandrel speed: up to 600 RPM
Stand-off: 30 mm
Spray material: Commercially pure Titanium
Particle diameter: 10-30 microns
Gas pressure: 38 bar
Gas: Nitrogen 99.999% pure
Carrier gas: Nitrogen 99.999% pure
Powder feed rate: 30 g/min
Traverse rate: 20 mm/min Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavor to which this specification relates.

Although the present invention has been illustrated and described with respect to several preferred embodiments thereof, various changes, omissions and additions to the form and detail thereof, may be made therein, without departing from the spirit and scope of the invention.

What is claimed is:

1. A method of manufacturing a pipe, the method comprising:

pre-heating a mandrel, the mandrel made of a single material having a coefficient of thermal expansion;

cold-gas dynamic spraying of particles of at least one of titanium or titanium alloy directly onto the material of the pre-heated mandrel to produce the pipe; and allowing the pre-heated mandrel and the pipe to cool prior to removal of the pipe from the mandrel, wherein the coefficient of thermal expansion of the pre-heated mandrel material is greater than the coefficient of thermal expansion of the pipe, so that separation of the pipe from the pre-heated mandrel takes place by contraction of the pre-heated mandrel away from the pipe when the pre-heated mandrel and the pipe are allowed to cool.

2. The method according to claim 1, wherein the surface of the pre-heated mandrel is smooth and defect-free.

3. The method according to claim 1, wherein the composition of the pipe varies along the length and/or across the thickness of the pipe.

4. The method according to claim 3, wherein the pipe comprises two or more discrete lengths and/or layers of different materials.

5. The method according to claim 3, wherein the composition of the pipe varies gradually along the length and/or across the thickness of the pipe.

6. The method according to claim 1, wherein the pipe comprises a material to confer corrosion and/or wear resistance to a surface of the pipe.

7. The method according to claim 1, wherein the pre-heated mandrel comprises surface features that impart an increased surface area to a corresponding surface of the pipe.

8. The method according to claim 1, wherein an average size of the particles and the operating parameters of the cold-gas dynamic spraying are selected so the pipe is free of connected micro-voids.

9. The method according to claim 1, further comprising after removal of the pipe from the mandrel applying a load to an outer surface of the pipe with a roller to at least one of size or finish of the pipe.

10. The method according to claim 1, further comprising applying a load to an outer surface of the pipe with a roller to at least one of size or finish of the pipe.

11. The method according to claim 1, wherein the particles have a diameter of 5 to 45 microns.

12. The method according to claim 1, wherein the mandrel includes a cavity extending through it.

13. The method according to claim 1, wherein the pipe is adapted to transport fluid either above or below ground or sub-sea, the fluid comprising at least one of acidic or alkaline fluids, water, oil, gas or chemicals.

14. A method of manufacturing a pipe, the method comprising:

pre-heating a mandrel formed entirely of a material having a first coefficient of thermal expansion, the material of the mandrel defining an outer surface of the mandrel;

cold-gas dynamic spraying particles of a second material onto the outer surface of the pre-heated mandrel to produce a pipe such that an inner surface of the pipe forms on the outer surface of the pre-heated mandrel, the second material comprising titanium or a titanium alloy and having a second coefficient of thermal expansion; and allowing the pre-heated mandrel to contract away from the inner surface of the pipe as the pre-heated mandrel and the pipe cool prior to removal of the pipe from the mandrel such that a difference between the first coefficient of thermal expansion and the second coefficient of thermal expansion separates the mandrel from the pipe.

15. The method according to claim 14, wherein the outer surface of the pre-heated mandrel is smooth and defect-free.

16. The method according to claim 14, wherein the composition of the pipe varies along the length and/or across the thickness of the pipe.

17. The method according to claim 16, wherein the pipe comprises two or more discrete lengths and/or layers of different materials.

18. The method according to claim 14, wherein an average size of the particles and the operating parameters of the cold-gas dynamic spraying are selected so the pipe is free of connected micro-voids.

19. A method of manufacturing a pipe, the method comprising:

pre-heating a mandrel, the mandrel having an inner surface or core and an outermost surface, the mandrel formed of a material having a first coefficient of thermal expansion at the inner surface or core and the outermost surface thereof;

cold-gas dynamic spraying particles of a second material onto the mandrel to produce a pipe such that an inner surface of the pipe forms on the outermost surface of the mandrel, the second material comprising titanium or a titanium alloy and having a second coefficient of thermal expansion; and removing the pipe from the mandrel after the pipe and the mandrel have cooled such that a difference between the first coefficient of thermal expansion and the second coefficient of thermal expansion separates the mandrel from the pipe.

20. The method according to claim 19, wherein cold-gas dynamic spraying particles of the second material onto the mandrel includes the outermost surface of the mandrel having structural features extending therefrom such that an inner surface of the pipe formed on the outermost surface has an increased surface area.

* * * * *